US011859931B2

(12) United States Patent
Hensley

(10) Patent No.: US 11,859,931 B2
(45) Date of Patent: Jan. 2, 2024

(54) AUTOMATICALLY ADJUSTABLE CARTRIDGE SIZE FIREARM

(71) Applicant: Trip Hensley, Scranton, AR (US)

(72) Inventor: Trip Hensley, Scranton, AR (US)

( * ) Notice: Subject to any disclaimer, the term of this patent is extended or adjusted under 35 U.S.C. 154(b) by 108 days.

(21) Appl. No.: 17/500,895

(22) Filed: Oct. 13, 2021

(65) Prior Publication Data

US 2023/0110810 A1 Apr. 13, 2023

(51) Int. Cl.

| | |
|---|---|
| ***F41A 9/46*** | (2006.01) |
| ***F41A 21/10*** | (2006.01) |
| ***F41A 15/14*** | (2006.01) |
| ***F42B 5/02*** | (2006.01) |

(52) U.S. Cl.

CPC ..... *F41A 21/10* (2013.01); *F41A 9/46* (2013.01); *F41A 15/14* (2013.01); *F42B 5/025* (2013.01)

(58) Field of Classification Search

CPC ..... F41A 9/00; F41A 9/01; F41A 9/38; F41A 9/46; F41A 99/00

USPC ..... 42/106, 14, 17, 16

See application file for complete search history.

*Primary Examiner* — Jonathan C Weber

(74) *Attorney, Agent, or Firm* — POLSINELLI LLP

(57) ABSTRACT

The present disclosure is directed to firearms that can receive and fire bullets from ammunition with different cartridge case sizes. For example, the receiver may fire a bullet from either a short cartridge, a medium cartridge, or long cartridge after the short, medium, or long cartridge is received by a receiver of the firearm. This firearm may include a receiver portion and a bolt portion that lock together at different relative locations when cartridges of different lengths are received by the receiver portion. The receiver portion may include a first type of alignment retention features (e.g. protrusions) and the bolt portion may include a second type of alignment retention features (e.g. recessions). Once a firearm cartridge is located inside of the firearm, it may be fired based on the receiver and the bolt portions being locked together via physical engagement of the different types of alignment retention features.

20 Claims, 12 Drawing Sheets

AUTOMATICALLY ADJUSTABLE CARTRIDGE SIZE FIREARM

BACKGROUND OF THE INVENTION

Field of Invention

The present invention generally relates to an adaptable firearm. More specifically, the present invention relates to a firearm that can fire ammunition of different lengths.

Description of the Related Art

Conventionally, firearms are often manufactured to use cartridges of a single specific size. A firearm cartridge includes a bullet that is fitted into a cartridge case that contains gunpowder and a primer. Once a cartridge has been placed into a firearm, a person may "fire" the firearm by pulling on a trigger. The pulling of the trigger releases a firing pin of the firearm that strikes a back end of the cartridge. The striking of the cartridge ignites volatile elements in the primer, the ignition of the primer then causes the gunpower in the cartridge to ignite. The ignition of the gunpowder creates an explosion of expanding gasses that force the bullet to be pushed down and out of a barrel of the firearm.

Most firearms, especially most rifles can only use cartridges of a single size that corresponds to a single length and a single width of a cartridge case. Exceptions to this general rule include certain .22 caliber firearms that can fire cartridges of different lengths (e.g. the 22 BB-Cap, the 22 short, and the 22 long/long rifle cartridges). Another exception is that 357 magnum handguns can fire 357 magnum cartridges and 38 caliber cartridge cases that have different lengths and a same width. In these instances, a location where the cartridge is received in the firearm and a location of another portion of the firearm are the same. In other words, the back end of a particular .22 cartridge or a 357 magnum/38 caliber ammunition is always located at a same location in the firearm. Because of this .22 caliber firearms and 357 magnum firearms can use cartridges of different lengths simply by receiving the entire cartridge in a receiver or in a cylinder of a respective firearm. The various .22, 38, and 357 cartridges include a cartridge case that is predominantly straight and do not include a tapered area (i.e. a shoulder) located where a bullet is placed when the cartridge is assembled. Many rifle cartridge cases include a tapered shoulder located at the end of the rifle cartridge. Because of this when a firearm designer designs a firearm to work with .22, 38, and 357 cartridges, that designer would not have to consider headspace that could be a concern for designers designing firearms that use cartridge cases that include shoulders.

Firearms are commonly used by the police and the military for purposes of law enforcement, war, and providing security. The police and the military use firearms that have different levels of power. For example, over the years the military has used 38, 45, 223 caliber, 30, 308, and .30-06 caliber ammunition in different firearms. The US military uses 223 caliber ammunition in the M16 Armalite rifle for use predominantly in short to medium range applications. The US military uses 308 ammunition in the AR-10 rifle for short, medium, and longer range applications. As compared to the 223 caliber ammunition, the 308 ammunition is larger and is a more powerful. This is because a 308 cartridge and bullet are larger than cartridge cases used in 223 ammunition and because the 308 cartridge holds more gunpowder than the 223 cartridge. Since the 308 cartridge is more powerful, bullets from a 308 rifle can travel farther faster and have greater energy over distance as compared to bullets fired from a 223 rifle. This makes the 308 caliber rifles more useful for longer range applications or for penetrating targets such as the doors of a vehicle.

Since a 308 bullet has more energy than a 223 bullet, the 308 bullet is more likely to push though a target or object than a 223 bullet. This can be an advantage or a disadvantage depending on circumstances. One disadvantage of the 308 caliber ammunition (or round) is that 308 rounds are bigger and heavier than 223 rounds. One hundred rounds of 308 caliber ammunition weigh about 3.49 pounds where one hundred rounds of 223 ammunition weighs about 1.94 pounds, the 308 round is about 1.8 times heavier than the weight of a 223 round. This means that a typical soldier will carry fewer 308 rounds than 223 rounds into combat.

The use of a less powerful round can be advantageous in applications where less penetration will result in a lower likelihood of collateral damage. Alternatively, the use of a more powerful round can be advantageous in applications where an enemy is hiding under cover of a barricade or behind a vehicle door.

A disadvantage to a military or police forces using different sized cartridges is that once ammunition of a specific size has been used up, a soldier or officer carrying a firearm that uses ammunition of that specific size will no longer be able to fire that firearm. As such, there is a need for firearms that can fire rounds of different sizes that each have a different amount of energy when fired from a firearm. What are also needed are firearms that can fire rounds of different sizes even when those rounds include cartridge cases that include shoulders.

SUMMARY OF THE CLAIMED INVENTION

The presently claimed invention relates to an apparatus capable of firing firearm cartridges of different lengths. In an embodiment the apparatus includes a receiver portion that includes a back end configured to receive a first firearm cartridge of a first length or a second firearm cartridge of a second length. This receiver portion may also include a front end and a hole that extends from the back end of the receiver portion to the front end of the receiver portion. Here the first firearm cartridge of the first length or the second firearm cartridge of the second length may be received at the back end of the receiver portion in the hole. This receiver portion may also include a first type retention features of a first shape. This apparatus may also include a bolt portion that includes a second type of retention features that have a second shape that engages with the first shape of the first type of retention feature.

When the firearm cartridge of the first length is arranged to be fired from the back end of the receiver portion, a first sub-set of the first type of retention features may be aligned and engaged with a first sub-set of the second type of retention features. Furthermore, when the firearm cartridge of the second length is arranged to be fired from the back end of the receiver portion, a second sub-set of the first type of retention features may be aligned and engaged with a second sub-set of the second type of retention features.

DETAILED DESCRIPTION

The present disclosure is directed to firearms that can receive and fire bullets from ammunition with different cartridge case sizes. For example, the receiver may fire a bullet from either a short cartridge, a medium cartridge, or long cartridge after the short, medium, or long cartridge is received by a receiver of the firearm. This firearm may include a receiver portion and a bolt portion that lock together at different relative locations when cartridges of different lengths are received by the receiver portion. The receiver portion may include a first type of alignment retention features (e.g. protrusions) and the bolt portion may include a second type of alignment retention features (e.g. recessions). Once a firearm cartridge is located inside of the firearm, it may be fired based on the receiver and the bolt portions being locked together via physical engagement of the different types of alignment retention features.

Figure 1:
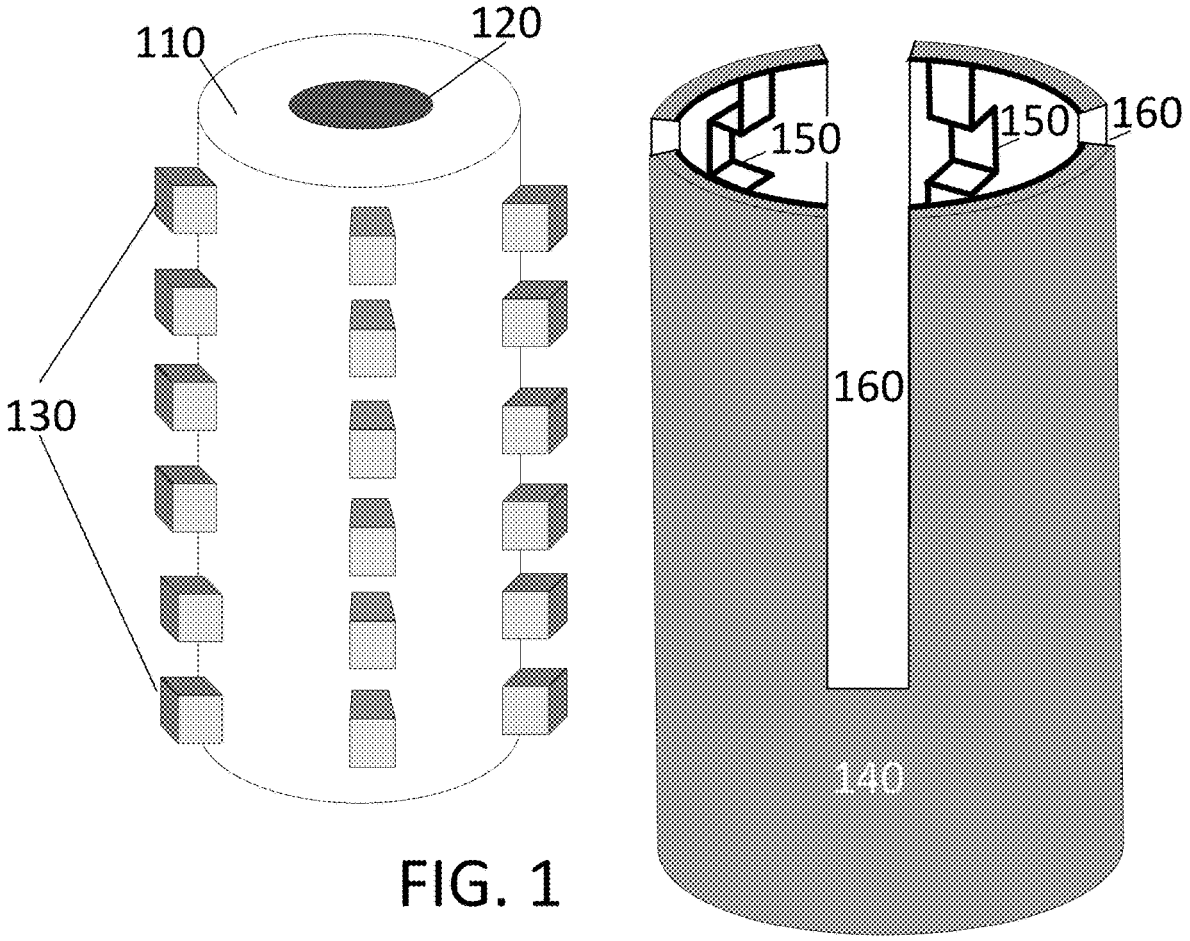
FIG. 1 illustrates two different parts that may be used in a firearm consistent with the present disclosure.

FIG. 1 illustrates two different parts that may be used in a firearm consistent with the present disclosure. FIG. 1 includes a receiver portion 110 and a portion of a bolt or bolt carrier 140. Receiver portion 110 includes a hole 120 and several sets of protrusions 130. The hole 120 may extend all the way through the length of receiver 110, the hole 120 located in the top of FIG. 1 may be part of a barrel of the firearm. A lower portion of receiver 110, not visible in FIG. 1 may include hole 120 that is configured to receive cartridges of different lengths.

The portion of the bolt or bolt carrier 140 of FIG. 1 includes various features on an internal surface of the bolt portion 140. These features include recessions 150 that are designed to mate with protrusions 130 of receiver portion 110 when the recessions of the bolt portion and protrusions of the receiver portion 110 are aligned. The portion of the bolt 140 may be sized to fit onto and over all parts of receiver portion 110. When the recession features 150 are aligned with protrusions 130, the bolt portion 140 and the receiver portion 110 may be locked together based on physical engagement of the protrusions 130 of receiver 110 and the recessions of the bolt portion. The process of locking mechanisms 110 & 140 together may include the rotation and movement of bolt portion 140. FIG. 1 also includes a series of slots 160. These slots could be included in the bolt portion 140 to reduce a mass of bolt portion as compared to a similar bolt portion that does not include slots 160. These slots may also allow relative movement of the bolt portion and receiver when the receiver 110 and the bolt portion 140 are not locked together.

Figure 2:
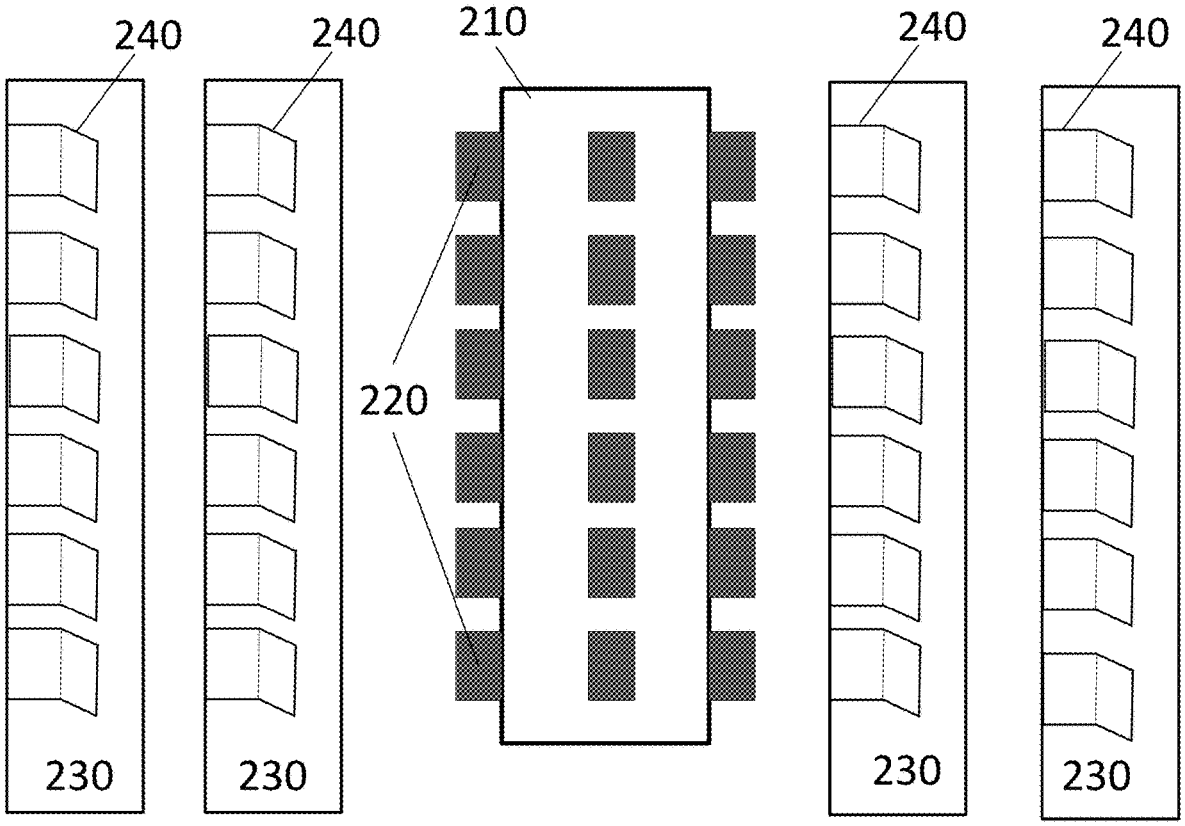
FIG. 2 illustrates side and cut out views of parts of a receiver and a bolt that have interlocking features.

FIG. 2 illustrates side and cut out views of parts of a receiver and a bolt that have interlocking features. FIG. 2 includes receiver 210 that is similar to the receiver 110 of FIG. 1. FIG. 2 also illustrates cut out bolt portions 230. Receiver 210 includes several sets of protrusions 220 that may engage with protrusions and recession features 240. The several different cut out bolt portions 230 may represent a bolt that has been cut apart. The recessions 240 of FIG. 2 may engage protrusions 230 when the recessions 240 are aligned with protrusions 230. Here again operation of the bolt may include rotating the bolt portion to a position where the recessions 240 do not engage protrusions 220.

Figure 3:
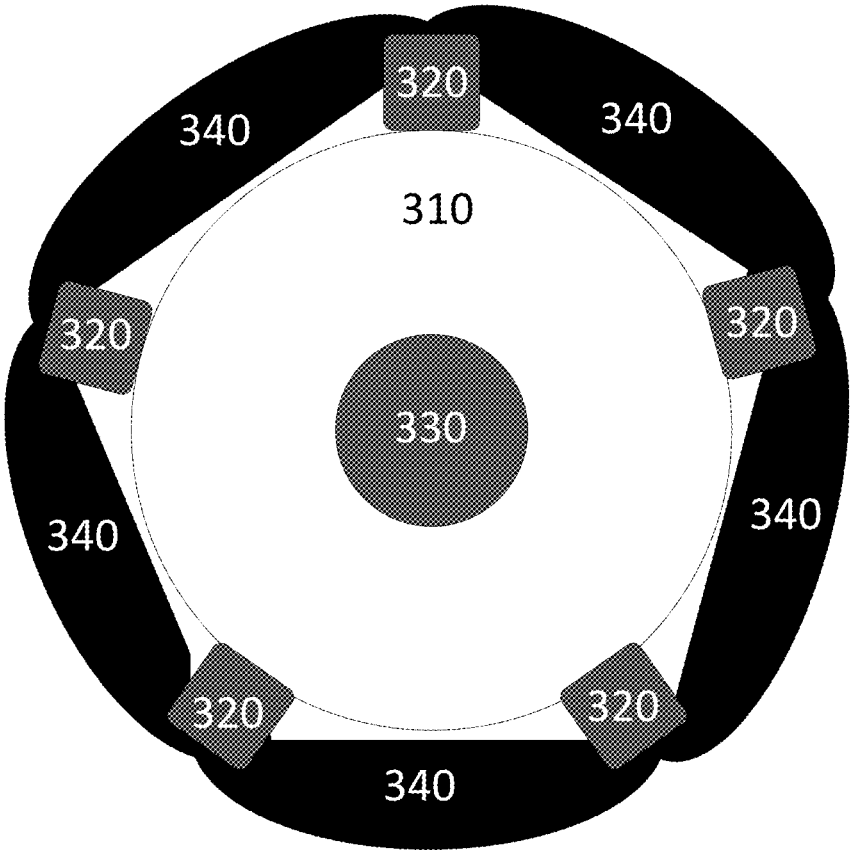
FIG. 3 illustrates a receiver and a bolt portion that are locked together in an orientation.

FIG. 3 illustrates a receiver and a bolt portion that are locked together in an orientation. FIG. 3 includes receiver 310 and a five-sided bolt portion 340. The receiver includes protrusions 320 and a hole 330 that extends through the receiver 310. Even though, recessions in the receiver 340 cannot be seen, protrusions 320 may be engaged by recessions included in bolt portion 340.

Figure 4:
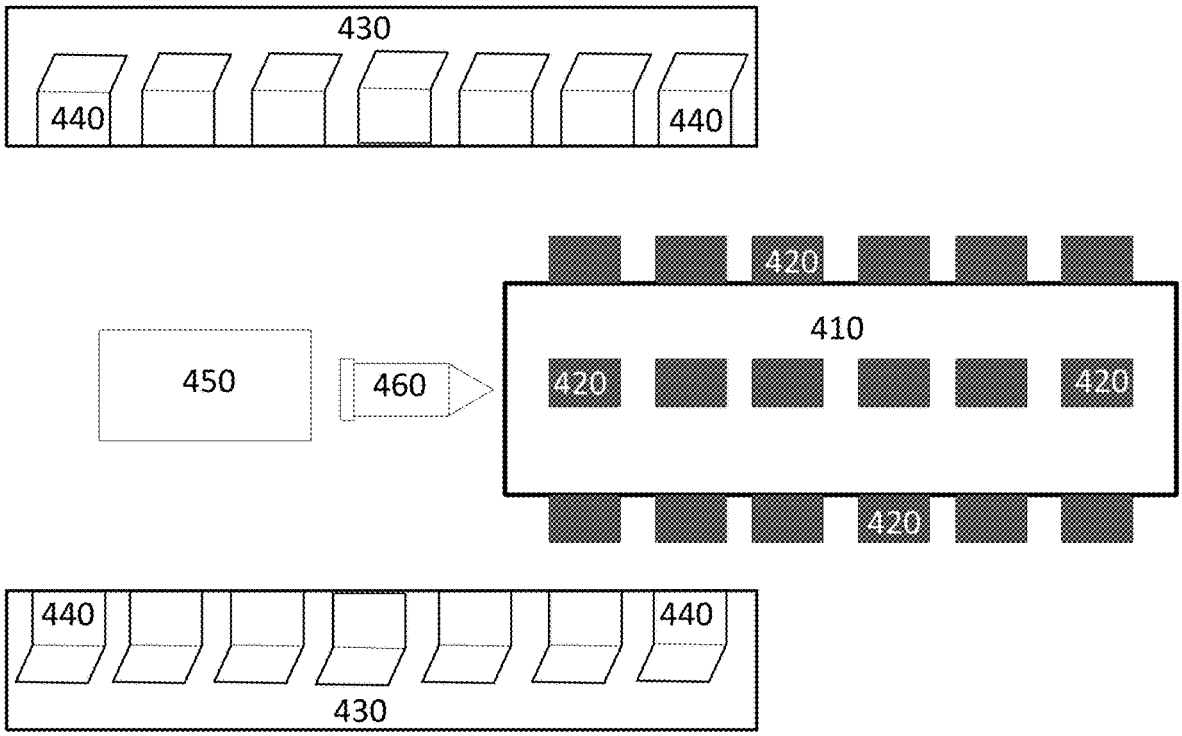
FIG. 4 illustrates a series of parts of a firearm when a small cartridge is about to be locked into the firearm.

FIG. 4 illustrates a series of parts of a firearm when a small cartridge is about to be locked into the firearm. FIG. 2 includes receiver 410, cutout bolt portions 430, a small sized ammunition cartridge 460, and an assembly 450 that contains a firing pin. The cutout bolt portions 430 include recessions 440 that may engage with protrusions 420 of receiver 410.

Figure 5:
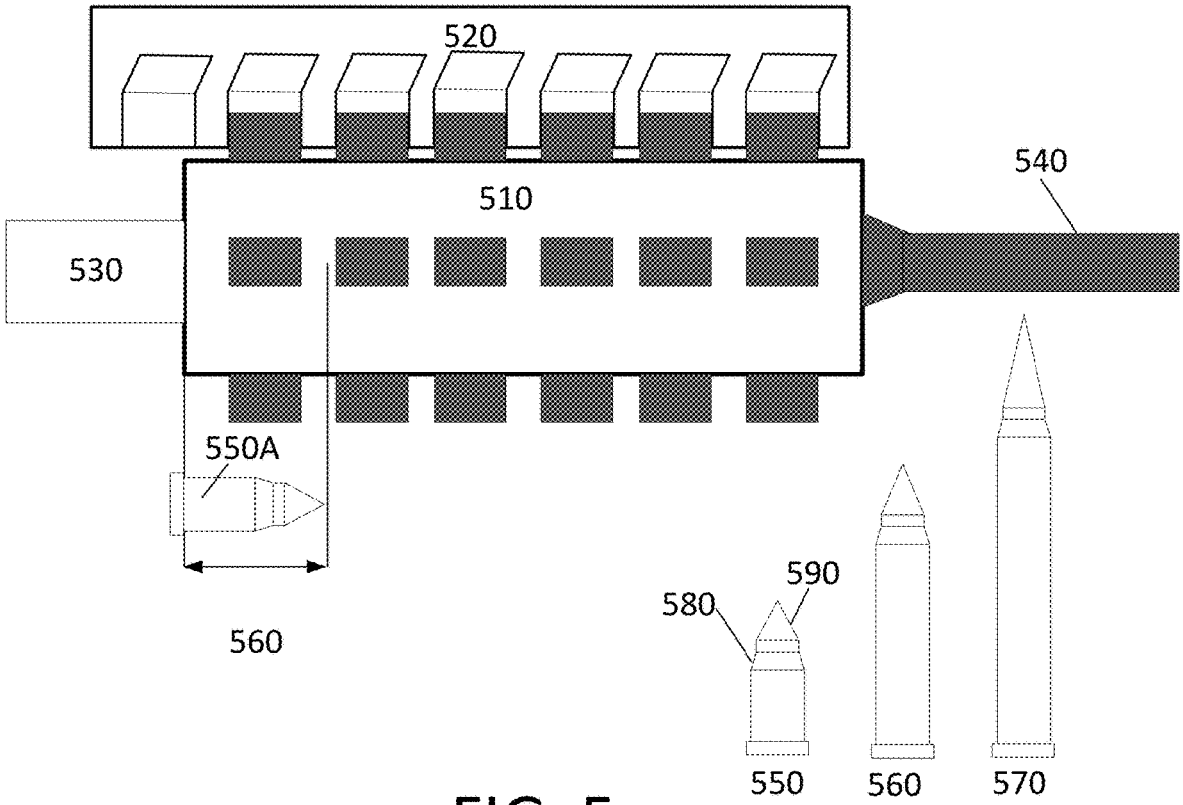
FIG. 5 illustrates relative positions of the series of parts of FIG. 4 when the small cartridge is locked into a receiver.

FIG. 5 illustrates relative positions of the series of parts of FIG. 4 when the small cartridge is locked into a receiver. FIG. 5 includes receiver 510, cutout bolt portion 520, firing pin assembly 530, barrel 540, and several cartridges (550, 550A, 560, & 570). FIG. 5 includes the same type of protrusions in receiver 510 that were illustrated in FIGS. 1-4, here however these protrusions are not numbered. The cutout bolt portion 520 of FIG. 5 also includes recessions that engage the receiver protrusions at a first relative location. While not illustrated in FIG. 5, cutout bolt portion 520 and firing pin assembly 530 may be part of a bolt carrier assembly that maintains a same relative position between the cutout bolt portion 520 and firing pin assembly 530.

FIG. 5 illustrates how far into receiver 510 that the small cartridge 550A protrudes into receiver 510 when a bolt carrier assembly is locked onto receiver 510. Since the firing pin assembly 530 pushes cartridge 550A into receiver 510 as illustrated by double arrowed line 560. The cartridges of FIG. 5 also include a tapered part or shoulder 580 located at the end of the cartridges where a bullet (i.e. projectile) 590 is placed with the cartridges are manufactured.

Figure 6:
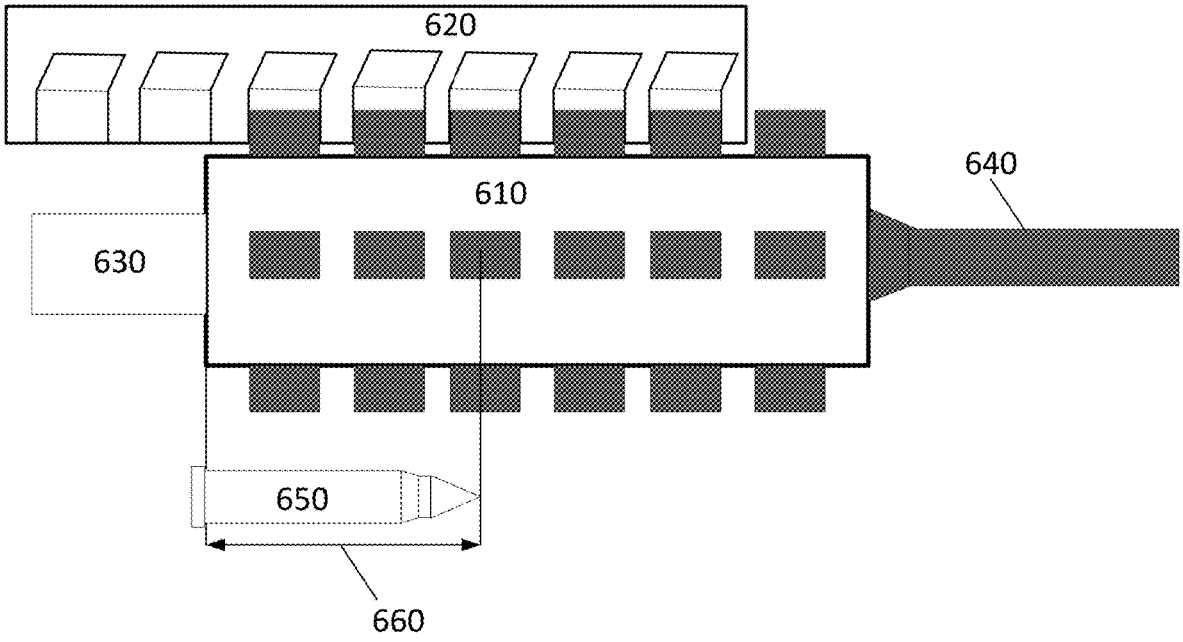
FIG. 6 illustrates relative positions of the series of parts of FIG. 5 when a medium sized cartridge is locked into a receiver.

FIG. 6 illustrates relative positions of the series of parts of FIG. 5 when a medium sized cartridge is locked into a receiver. FIG. 6 includes receiver 610, cutout bolt portion 620, firing pin assembly 630, barrel 640, and cartridge 650. FIG. 6 includes the same type of protrusions in receiver 610 that were illustrated in FIGS. 1-4, here however these protrusions are not numbered. The cutout bolt portion 620 of FIG. 6 also includes recessions that engage the receiver protrusions at a second relative location. While not illustrated in FIG. 6, cutout bolt portion 620 and firing pin assembly 630 may be part of a bolt carrier assembly that maintains a same relative position between the cutout bolt portion 620 and firing pin assembly 630.

FIG. 6 illustrates how far into receiver 610 that the medium sized cartridge 650 protrudes into receiver 610 when a bolt carrier assembly is locked onto receiver 510. Since the firing pin assembly 630 pushes cartridge 650 into receiver 610 as illustrated by double arrowed line 660. Note that the different length of cartridge 650 as compared to cartridge 550A of FIG. 5 results in different protrusions of the receiver of these figures engaging different sets of recessions of the cutout bolt portions. In FIG. 5, all of the six rows of receiver protrusions engage recessions of the cutout bolt carrier portion, yet in FIG. 6 only five rows of the receiver protrusions engage recessions of the cutout bolt carrier portion.

Figure 7:
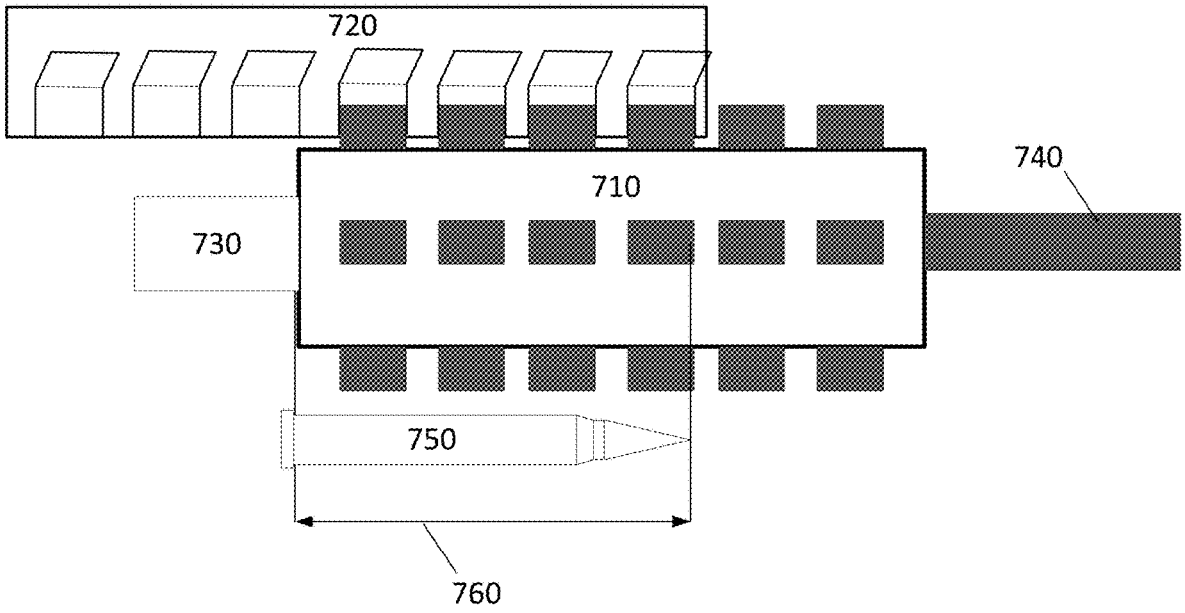
FIG. 7 illustrates relative positions of the series of parts of FIGS. 5-6 when a larger sized cartridge is locked into a receiver.

FIG. 7 illustrates relative positions of the series of parts of FIGS. 5-6 when a larger sized cartridge is locked into a receiver. FIG. 7 includes receiver 710, cutout bolt portion 720, firing pin assembly 730, barrel 740, and cartridge 750. FIG. 7 includes the same type of protrusions in receiver 510 that were illustrated in FIGS. 1-4, here however these protrusions are not numbered. The cutout bolt portion 720 of FIG. 7 also includes recessions that engage the receiver protrusions at a third relative location. While not illustrated in FIG. 7, cutout bolt portion 720 and firing pin assembly 730 may be part of a bolt carrier assembly that maintains a same relative position between the cutout bolt portion 720 and firing pin assembly 730.

FIG. 7 illustrates how far into receiver 710 that the larger cartridge 750 protrudes into receiver 710 when a bolt carrier assembly is locked onto receiver 710. Since the firing pin assembly 730 pushes cartridge 750 into receiver 710 as illustrated by double arrowed line 760. Note that the different length of cartridge 750 as compared to cartridges 550A and 650 of FIGS. 5-6 results in different protrusions of the receiver of these figures engaging different sets of recessions of the cutout bolt portions. In FIG. 5 all of the six rows of receiver protrusions engage recessions of the cutout bolt carrier portion, in FIG. 6 five rows of the receiver protrusions engage recessions of the cutout bolt carrier portion, and in FIG. 7 only four rows of the receiver protrusions engage recessions of the cutout bolt carrier portion.

FIGS. 5, 6, and 7 illustrate that the firearms consistent with the present disclosure may be configured to receive cartridges that include shoulders. Even so, firearms consistent with the present disclosure may be configured to receive any type of firearm cartridges, whether those cartridges include shoulders or not.

Figure 8:
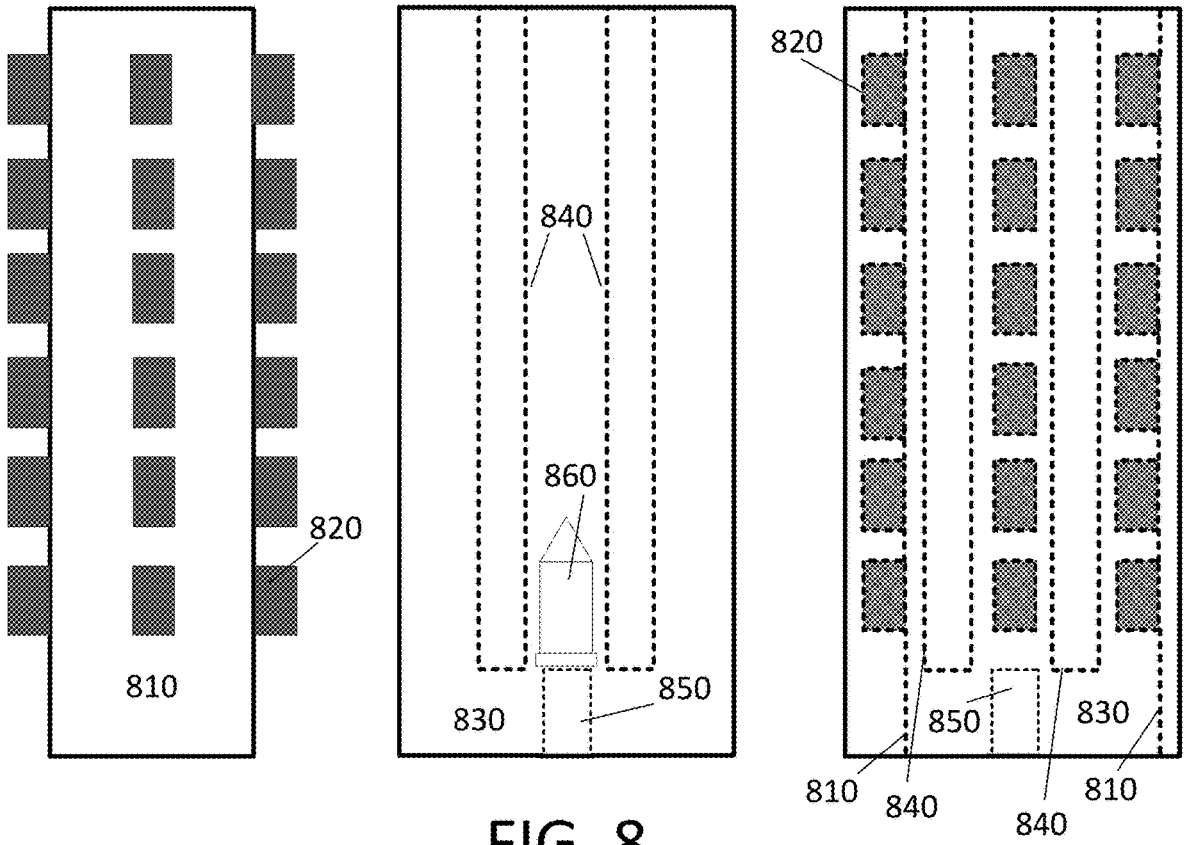
FIG. 8 illustrates three different images including an image of a receiver portion, an image of a bolt portion, and an image that includes the receiver portion surrounded by the bolt portion.

FIG. 8 illustrates three different images including an image of a receiver portion, an image of a bolt portion, and an image that includes the receiver portion surrounded by the bolt portion. Receiver portion 810 located on the left of FIG. 8 includes a plurality of protrusions 820. The middle image of FIG. 8 includes a bolt portion 830 that includes slots 840 and protrusion 850. Firearm cartridge 860 is illustrated in the central image of FIG. 8 to show a location where a firearm cartridge would be located when that cartridge is locked in place within receiver portion 810. For clarity, this central image of FIG. 8 does not show the receiver portion located within the portion 830.

The slots 840 in the center of FIG. 8 may be locations where the bolt portion could move relative to the receiver portion 810 when the slots 840 are oriented in a direction that do not lock the receiver portion 810 and the bolt portion 830 together. Slots 840 are illustrated with dashed lines to indicate that these slots may not be voids that cut through a cross section of bolt portion 830.

The image on the right side of FIG. 8 illustrates the receiver portion 810 contained within the bolt portion 830. The image on the right side of FIG. 8 include protrusions 820 of receiver portion 810, slots 840 of bolt portion 830, and firing pin assembly 850 where most of these features are depicted with dashed lines that identify those portions that are contained within bolt portion 830. Firing pin assembly 850 may be a sub-assembly that is attached to bolt portion 830. Here a firing pin contained within firing pin assembly 850 may be used to strike cartridge 860 when that cartridge is fired.

Figure 9:
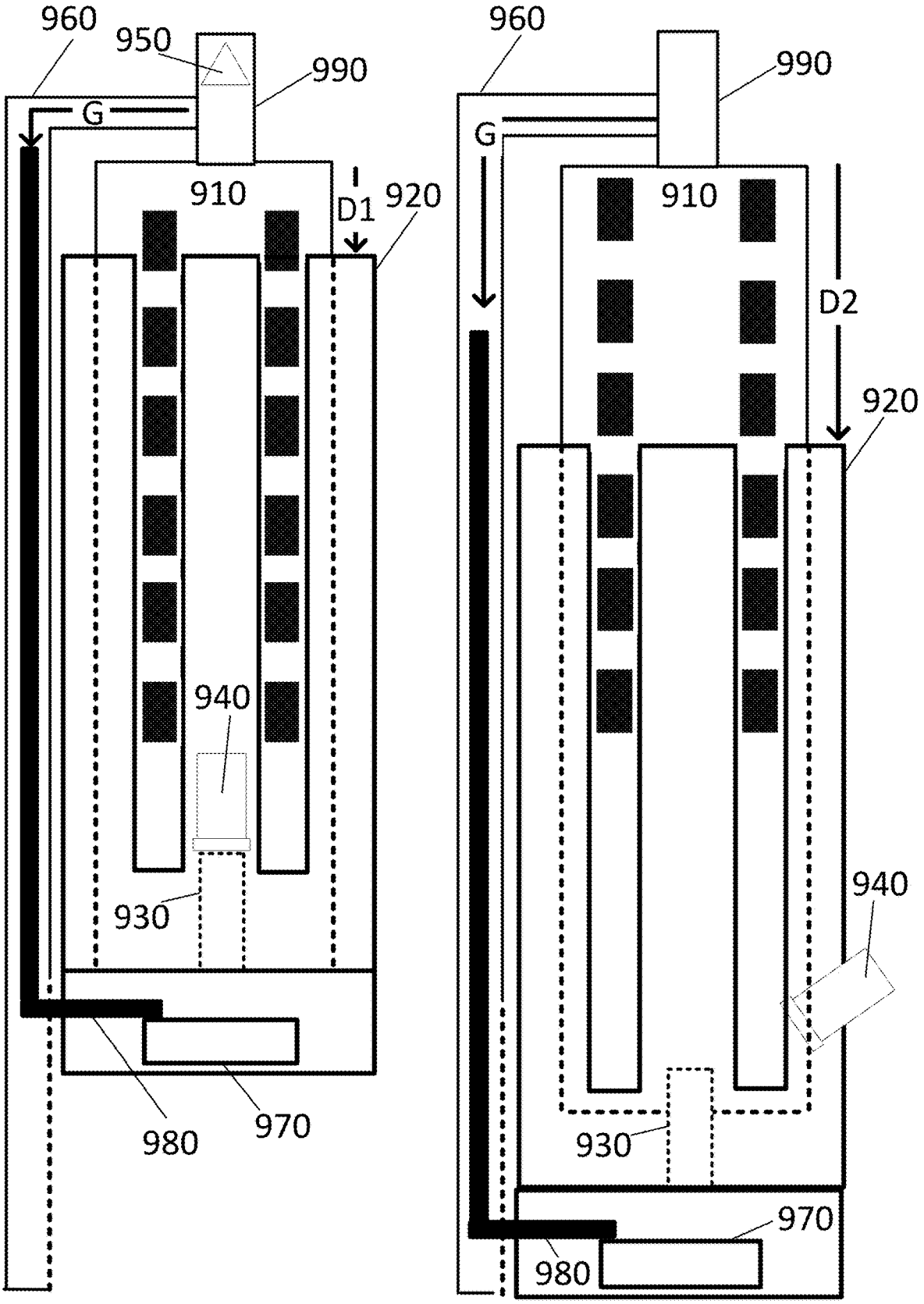
FIG. 9 includes two images that depict the operation of a mechanism consistent with the present disclosure.

FIG. 9 includes two images that depict the operation of a mechanism consistent with the present disclosure. FIG. 9 includes receiver portion 910, bolt portion 920, firing pin sub-assembly 930, cartridge case 940, bullet 950, gas tube 960, cam 970, piston 980, and barrel 990. The images of FIG. 9 show changes in relative position of receiver portion 910 and bolt portion 920 shortly after a firearm cartridge has been fired.

Note that in the left image of FIG. 9, bullet 950 has just passed an input of gas tube 960 that is attached to barrel 990. As bullet 950 passes the input of the gas tube 960, gas produced by the firing of gunpowder included in the firearm cartridge flows down gas tube 960. The gas flowing into the tube is illustrated by an arrowed line marked with the capital letter "G." As the bullet 950 moves down barrel 990, gas G pushes on piston 980, forcing piston 980 down such that cam 970 turns and then pushes bolt portion 920 in a backward (downward in FIG. 9) direction. Arrowed lines, one labeled D1 in the left image of FIG. 1 and another labeled D2 in the right image of FIG. 1 shows relative motion between bolt portion 920 and receiver 910. This relative motion continues to location D2 where cartridge case 940 is forced to exit the firearm.

FIG. 9 also includes protrusions illustrated as black blocks and slots illustrated as black lines between which the protrusions (black blocks) of FIG. 9 are located. The relative orientation of these protrusions in FIG. 9 allow the relative motion of bolt portion 920 and receiver portion 910 based on the protrusions of FIG. 9 and recessions (not shown in FIG. 9) included in bolt portion 920 being disengaged. While FIG. 9 illustrates the protrusions being located within the slots, relative motion of bolt portions and receiver portions do not require the protrusions being located exactly as FIG. 9 illustrates. Rotational motion to unlock a bolt from a receiver may only require a few degrees of rotation.

Figure 10:
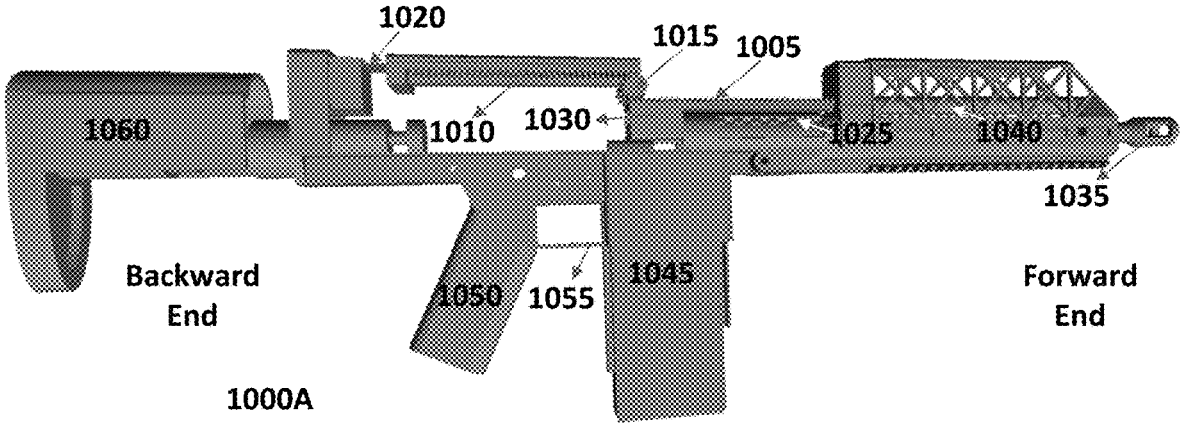
FIG. 10 illustrates two different views of parts of a firearm consistent with the present disclosure.
Figure 10:
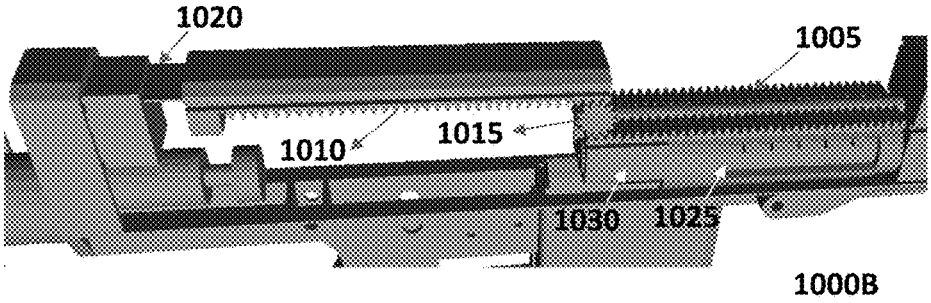

FIG. 10 illustrates two different views of parts of a firearm consistent with the present disclosure. FIG. 10 includes a side view 1000A located above a partial expanded perspective view 1000B of a semi-automatic rifle capable of firing firearm cartridges of different sizes. Each of the views of FIG. 10 include a first set of gear teeth 1005, a second set of gear teeth 1010, gear 1015, constant force spring 1020, receiver 1025, and bolt assembly 1030. The upper firearm image 1000A also includes barrel 1035, gas tube 1040, cartridge magazine 1045, handle 1050, trigger guard 1055, and butt 1060.

After a cartridge is fired in the firearm, pressurized gas generated from the firing of the cartridge moves into the gas tube 1040. This gas may force a piston in a (backward/left) direction opposite to the direction that a bullet exits (forward/right) barrel 1035. FIG. 10 identifies that the backward end of the firearm of FIG. 10 includes butt 1060 and that the forward end of the firearm is located at a right side of barrel 1035.

Force from the gas may force the piston, such as the piston of FIG. 9 to actuate a cam mechanism that may cause a portion of bolt assembly 1030 to rotate and that may also force the bolt assembly 1020 backward (to the left of FIG. 10). The cam mechanism of FIG. 10 may be included in aback part of bolt assembly 1030. Motion of the bolt assembly 1030 may also cause gear teeth 1005 to move backward (left) to a point where a cartridge case is ejected from the rifle of FIG. 10. The movement of gear teeth 1005 will force gear 1015 to rotate and engage gear teeth 1010. This action will pull gear teeth 1010 toward the forward end of the rifle, stretching constant force spring 1020. After the cartridge case is ejected from the rifle, force exerted by spring 1020 will force the bolt assembly 1030 forward. At this moment a new cartridge located in cartridge magazine 1045 may be pushed into receiver 1025 and the cam of bolt assembly 1030 will return to its original position locking bolt assembly 1030 and receiver 1025 together. The process of firing the rifle of FIG. 10 may continue until all new cartridges in magazine 1045 have been fired. Alternatively, a cartridge locked into the rifle of FIG. 10 may be removed by pulling on a lever (not illustrated) attached to bolt assembly 1030.

Note that the partial expanded perspective view 1000B of FIG. 10 illustrates that gear teeth 1005 may include two separate rows of parallel teeth. In such an instance, the rifle of FIG. 10 may include two different gears, where each respective gear moves along either a row of teeth on the left side of the rifle or along a rog of teeth on the right side of the rifle. The two gear teeth may also engage two separate rows of teeth of gear teeth 1010.

Figure 11:
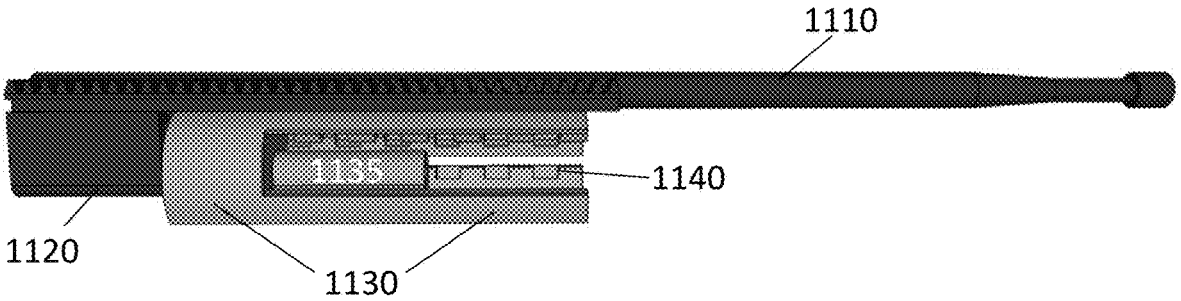
FIG. 11 illustrates a gas tube that may be included in a firearm that is coupled to a bolt assembly of a firearm.

FIG. 11 illustrates a gas tube that may be included in a firearm that is coupled to a bolt assembly of a firearm. Item 1110 of FIG. 11 is a gas tube that may include a piston as discussed in respect to FIGS. 9-10. FIG. 11 also includes a bolt assembly including elements or features 1120, 1130, 1135, & 1140. Item 1120 may be a back portion of the bolt assembly that includes an internal cam mechanism. Item 1130 may be the bolt assembly portion discussed in respect to FIGS. 1-9. Item 1135 may be a firing pin sub-assembly (discussed in respect to FIGS. 4-9) that acts to push cartridges into a receiver. Sub-assembly 1135 may include a firing pin that strikes a primer included in a firearm cartridge. Item 1145 of FIG. 11 is a recession of a portion of a bolt assembly discussed in respect to FIGS. 1-8.

When the bolt assembly of FIG. 11 closes, the central rod (subassembly 1135) on the bolt may push a round (cartridge) into the chamber until a shoulder of the round hits a matching taper in a chamber where the round is received. This may then cause the bolt to stop moving forward, while the bolt carrier continues forward under inertia and spring force. Those forces may cause a cam pin and surface to rotate the bolt into the locked position. The fit between the cartridge and chamber may be tight yet may not be perfect. When the cartridge fires, the ductile metal of the cartridge case (typically brass) expands, sealing the chamber and preventing or mitigating gas leakage. This process is called obturation. This may avoid gas leakage without having an interference fit between the cartridge and walls where the round (cartridge) is chambered. The rounds (cartridges) and rifles may be made to close enough tolerances that the cartridge expanding under pressure can form a seal based on obturation of the ductile cartridge case metal.

Figure 12:
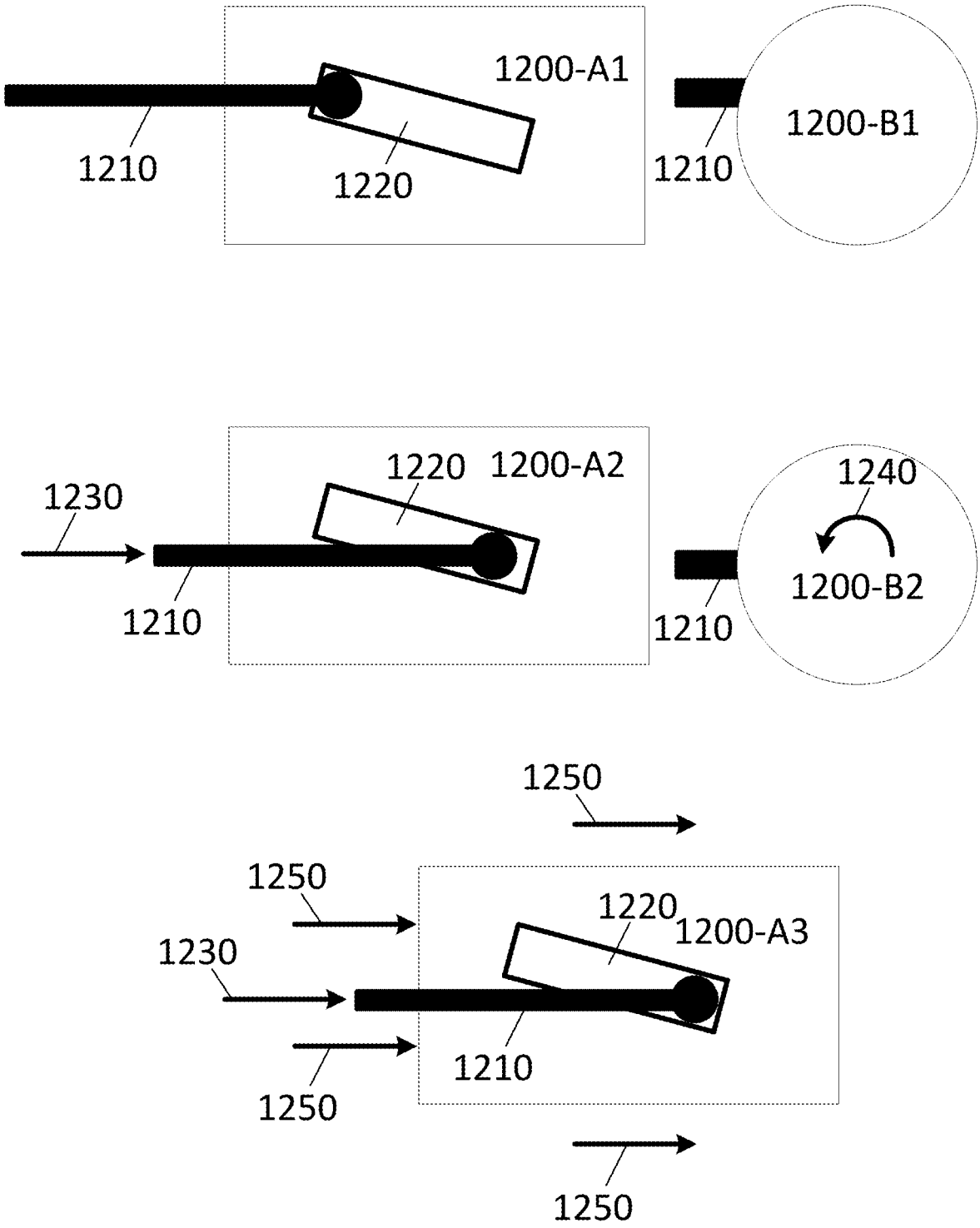
FIG. 12 illustrates a cam mechanism coupled to a piston that may be used to force a portion of a bolt to rotate and move in a backward direction after a cartridge is fired in a firearm consistent with the present disclosure.

FIG. 12 illustrates a cam mechanism coupled to a piston that may be used to force a portion of a bolt to rotate and move in a backward direction after a cartridge is fired in a firearm consistent with the present disclosure. FIG. 12 includes images of a cam in three different positions 1200-A1, 1200-A2, and 1200-A3. FIG. 12 also includes images 1200-B1 and 1200-B2 of a back end of the cam mechanism of FIG. 12. The cam mechanism of FIG. 12 includes piston 1210 and groove 1220. The top images 1200-A1 & 1200-B1 show the cam mechanism of FIG. 12 in a resting position. The middle images 1200-A2 & 1200-B2 show piston 1210 moving in the direction of arrow 1230 (toward the right of FIG. 12) based on the movement of gas as discussed in respect to FIG. 9. Note that piston 1210 moves along groove 1220 forcing the cam mechanism to rotate in counterclockwise direction 1240. The bottom image of FIG. 12 illustrates movement of the piston continue along the direction of arrow 1230 after piston 1210 has reached the end of groove 1220. After piston 1210 reaches the end of groove 1220, further motion of the piston as indicated by arrow 1230 forces the entire cam mechanism of FIG. 12 to the right along arrows 1250.

After a cartridge case has been ejected from the firearm based on movement of a bolt assembly attached to the cam mechanism, the cam mechanism and the bolt assembly may be forced back into an original position based on spring force as discussed in respect to FIG. 10.

While FIGS. 10-12 include features of an automatic or semi-automatic firearm, a firearm may include a manually operated bolt assembly. Here a person operating the firearm could chamber a round by grabbing a protrusion and moving that protrusion in an upward (or downward) direction to rotate a bolt assembly. The person could then manually move the bolt assembly backward, potentially ejecting a previously fired cartridge case, push the bolt forward, and then rotate the bolt assembly back to a locking position. This operation is very similar to how conventional bolt action rifles (e.g. the M1903 Springfield rifle). Here, however sets recessions and protrusions consistent with the present disclosure would allow cartridges of different lengths to be locked into a receiver and fired.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

What is claimed is:

1. An apparatus that fires ammunition of different sizes, the apparatus comprising:

a receiver portion that includes:

a back end configured to receive a first firearm cartridge of a first length or a second firearm cartridge of a second length, a front end, a hole that extends from the back end of the receiver portion to the front end of the receiver portion, wherein the first firearm cartridge of the first length or the second firearm cartridge of the second length are received in the hole at the back end of the receiver portion, and a first type retention features of a first shape; and a bolt portion comprising:

a second type of retention features that have a second shape that engages with the first shape of the first type of retention features, wherein:

a first sub-set of the first type of retention features engage with a first sub-set of the second type of retention features when the first sub-set of sub-set of the first type of retention features and the first sub-set of the second type of retention features are aligned and when the firearm cartridge of the first length is arranged to be fired from the back end of the receiver portion, and a second sub-set of the first type of retention features engage with a second sub-set of the second type of retention features when the second sub-set of sub-set of the first type of retention features and the second sub-set of the second type of retention features are aligned and when the firearm cartridge of the second length is arranged to be fired from the back end of the receiver portion.

2. The apparatus of claim 1, further comprising a gas port that provides a gas to move the bolt portion relative to the receiver portion.

3. The apparatus of claim 2, further comprising a piston disposed within the gas port that is mechanically coupled to the bolt portion of the assembly, wherein movement of the gas along the gas port pushes the piston such that the bolt portion moves in a backward direction and a cartridge case of at least one of the first cartridge or the second cartridge is ejected from the receiver portion of the apparatus.

4. The apparatus of claim 2, further comprising:

a first set of gear teeth;

a second set of gear teeth;

a first gear that:

contacts the first set of gear teeth and the second set of gear teeth, and rotates when the bolt portion of the apparatus moves relative to the receiver portion of the apparatus; and a spring physically connected to the second set of gear teeth that provides a force associated with the relative motion.

5. The apparatus of claim 4, further comprising:

a third set of gear teeth that are parallel to and that are rigidly connected to the first set of gear teeth;

a fourth set of gear teeth that are parallel to and that are rigidly connected to the second set of gear teeth; and a second gear that is physically connected to the first gear and that:

contacts the third set of gear teeth and the second set of gear teeth, and rotates when the bolt portion of the apparatus moves relative to the receiver portion of the apparatus.

6. The apparatus of claim 4, wherein the spring is a constant force spring.

7. The apparatus of claim 2, further comprising a cam coupled to the bolt portion that rotates the bolt portion based on movement of the gas.

8. The apparatus of claim 7, wherein the cam is coupled to a gas actuated piston.

9. The apparatus of claim 2, further comprising a magazine that connects to a lower portion of apparatus that provides at least one of the first cartridge or the second cartridge for receipt by the receiver portion when the bolt portion moves in a forward direction.

10. The apparatus of claim 9, further comprising a protrusion that allows a person to move the bolt portion in a backward direction when the person pulls the protrusion in the backward direction.

11. The apparatus of claim 1, further comprising a protrusion that allows a person to rotate the bolt portion and move the bolt portion in a backward direction based on actions performed by the person.

12. The apparatus of claim 1, further comprising a barrel connected to the receiver portion that allows a bullet to pass from the hole of the receiver portion through the barrel after the bullet separates from at least one of the first cartridge or the second cartridge.

13. The apparatus of claim 1, wherein a third sub-set of the first type of retention features engage with a third sub-set of the second type of retention features when the third sub-set of sub-set of the first type of retention features and the third sub-set of the second type of retention features are aligned and when a firearm cartridge of a third length is arranged to be fired from the back end of the receiver portion.

14. The apparatus of claim 1, wherein the first type of retention features are protrusions and the second type of retention features are recessions and the bolt portion is locked into place relative to the receiver portion based on the engagement of the protrusions and the recessions.

15. The apparatus of claim 1, wherein the first type of retention features are recessions and the second type of retention features are protrusions and the bolt portion is locked into place relative to the receiver portion based on the engagement of the recessions and the protrusions.

16. The apparatus of claim 1, wherein the first length of the first firearm cartridge is associated with a distance from a back end of a first cartridge case and a front end of the first cartridge case.

17. The apparatus of claim 1, the second length of the second firearm cartridge is associated with a distance from a back end of a second cartridge case and a front end of the second cartridge case.

18. The apparatus of claim 1, further comprising a subassembly that includes a protruding portion and a firing pin, the protruding portion connected to the bolt portion that retains at least one of the first firearm cartridge or the second firearm cartridge at the back end of the receiver portion.

19. The apparatus of claim 18, wherein the at least one of the first firearm cartridge or the second firearm cartridge is held at the back end of the receiver portion until the firing pin actuates.

20. The apparatus of claim 18 wherein the at least one of the first firearm cartridge or the second firearm cartridge is held at the back end of the receiver portion until an operator of the apparatus manually ejects the at least one of the first firearm cartridge or the second firearm cartridge.

* * * * *